United States Patent [19]

Loerch

[11] Patent Number: 4,664,637

[45] Date of Patent: May 12, 1987

[54] OAR

[76] Inventor: Mark P. Loerch, 161 East Lake Blvd., Winona, Minn. 55987

[21] Appl. No.: 801,915

[22] Filed: Nov. 26, 1985

[51] Int. Cl.[4] ..... B63H 16/04

[52] U.S. Cl. ..... 440/101; 440/107

[58] Field of Search ..... 440/101-110

[56] References Cited

U.S. PATENT DOCUMENTS

| | | | |
|---|---|---|---|
| 231,016 | 8/1880 | Davis | 440/106 |
| 2,213,538 | 9/1940 | Whitehead | 440/101 |
| 3,025,538 | 3/1962 | Holand | 440/101 |
| 3,324,490 | 6/1967 | Jewett | 440/101 |

*Primary Examiner*—Jeffrey V. Nase
*Assistant Examiner*—C. T. Bartz

[57] ABSTRACT

The oar disclosed herein is re-enforce by a stay which is anchored at both ends of the oar shaft and is supported near the oar lock location by a brace. The two points, where the stay emanates from the oar shaft, lie in the same plane as a set of points at the tip of the brace. The points, that define the aforementioned plane may be aligned to form a triangle. The triangle is assigned a vertex near the tip of the brace. When the oar blade is normal to the water surface during an oar stroke, the vertex of the aforementioned triangle points downwardly with respect to the force direction of the blade in the water. The stroke forces thereby produce a moment that tends to unfeather the oar blade. The unfeathering of the oar blade must be arrested by an oar lock as soon as the blade surface becomes normal to the water surface. To maintain the oar blade in the proper position during the stroke requires no handle torque as long as the oar lock of the oar is equipped with a stop to prevent further unfeathering of the oar.

3 Claims, 8 Drawing Figures

OAR

BACKGROUND

This invention relates to sculling oars that are reenforced with stays and braces, and specifically to any oar for which the blade force and the handle force do not intersect the feathering rotation axis of the oar during the stroke.

The following U.S. patent defines a mechanism which would appear to be germane to the patentability of the disclosed invention:

No. 231,016 M. F. Davis, Aug. 10, 1880

The patent of Davis teaches that the handle centerline of an oar may be offset from the feathering rotation axis to counteract the moment that is produced during the stroke when the larger portion of the oar blade is below the feathering rotation axis of the oar.

In the disclosed invention, a brace and a stay are mounted to the oar shaft in such manner as to bow the ends of the oar shaft toward the brace. If the oar blade is oriented so that the blade force acts above the feathering rotation axis during the stroke, the force will tend to feather the oar. The oarsman may apply a countermoment at the oar handle in order to eliminate the feathering tendency of the oar. Alternatively, if the oar blade is oriented so that the blade force acts below the feathering rotation axis, the force will tend to unfeather the oar. The unfeathering of the oar is desirable during the stroke as long as an oar lock stop is provided to properly orient the oar blade.

SUMMARY

An object of this invention is to provide an improved oar of lightweight construction with exceptional stiffness. This is accomplished by means of a stay which is anchored near both ends of the oar shaft and is supported near the oar lock rotation by a brace. A second object is to create during the stroke a force system, in which the oar blade surface, being normal to the water surface, tends to unfeather the oar and to hold the oar shaft against a stop of an oar lock. This is achieved by the downward angling of the stay and brace alignment from the blade force direction.

DRAWINGS

DESCRIPTION

Figure 1:
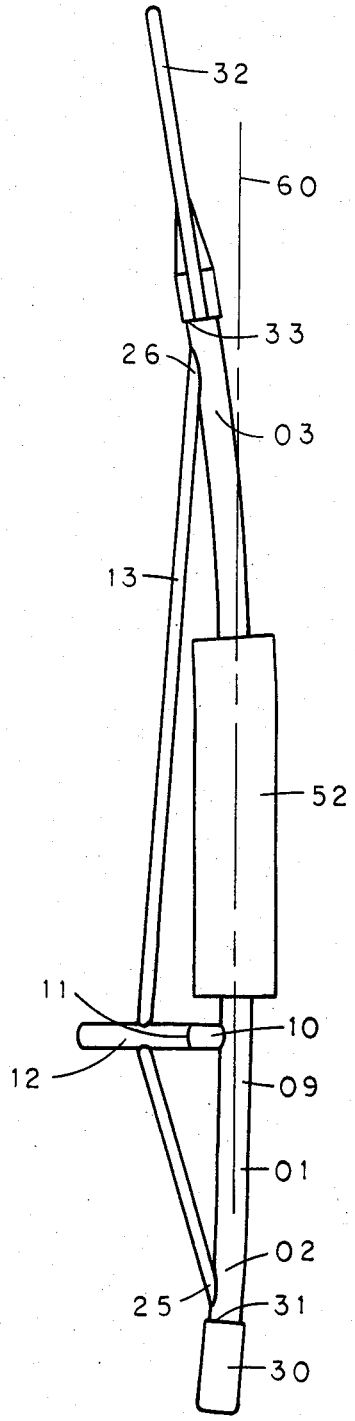
FIG. 1 is a top view of the oar in the normal position.
Figure 2:
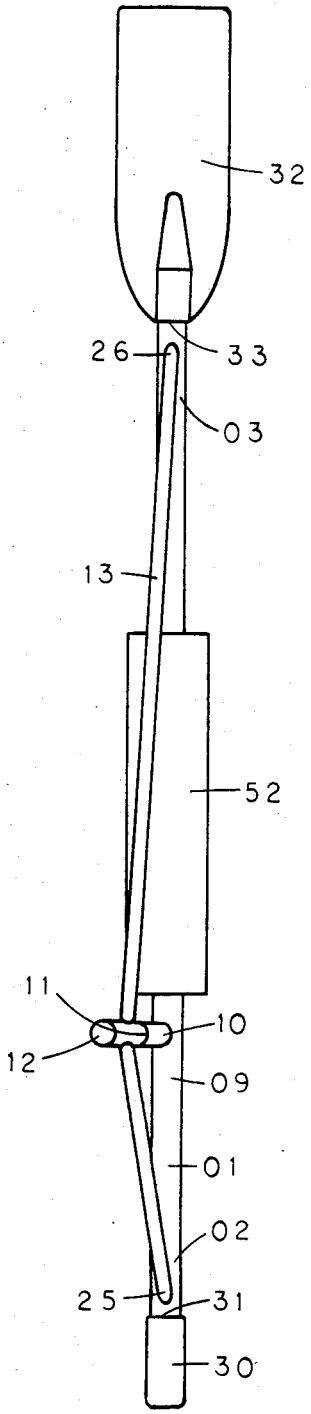
FIG. 2 is a top view of the oar after the oar has been rotated to the feathered position.
Figure 3:
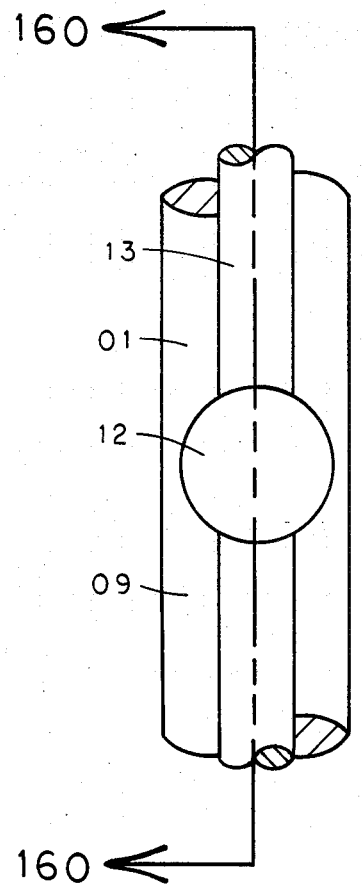
FIG. 3 is a top view of the guide.
Figure 4:
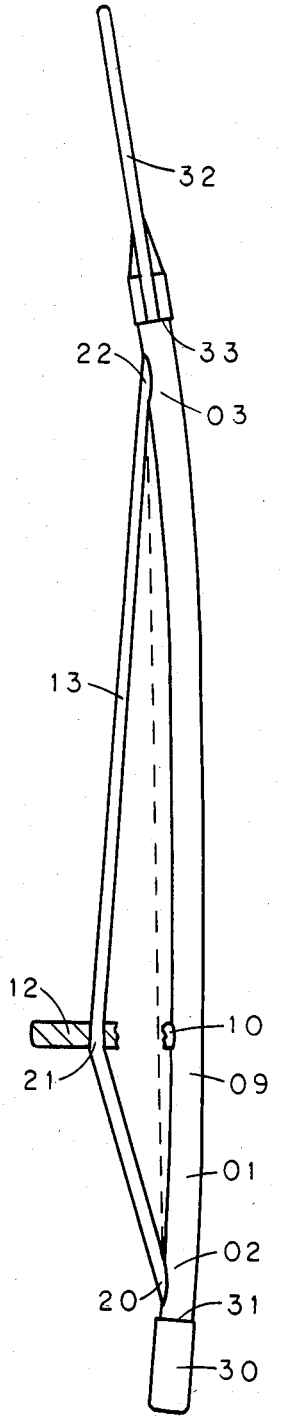
FIG. 4 is the view of FIG. 1 with a sectional view of the guide broken away from the brace. The guide has been sectioned at line 160, 160 of FIG. 3.
Figure 5:
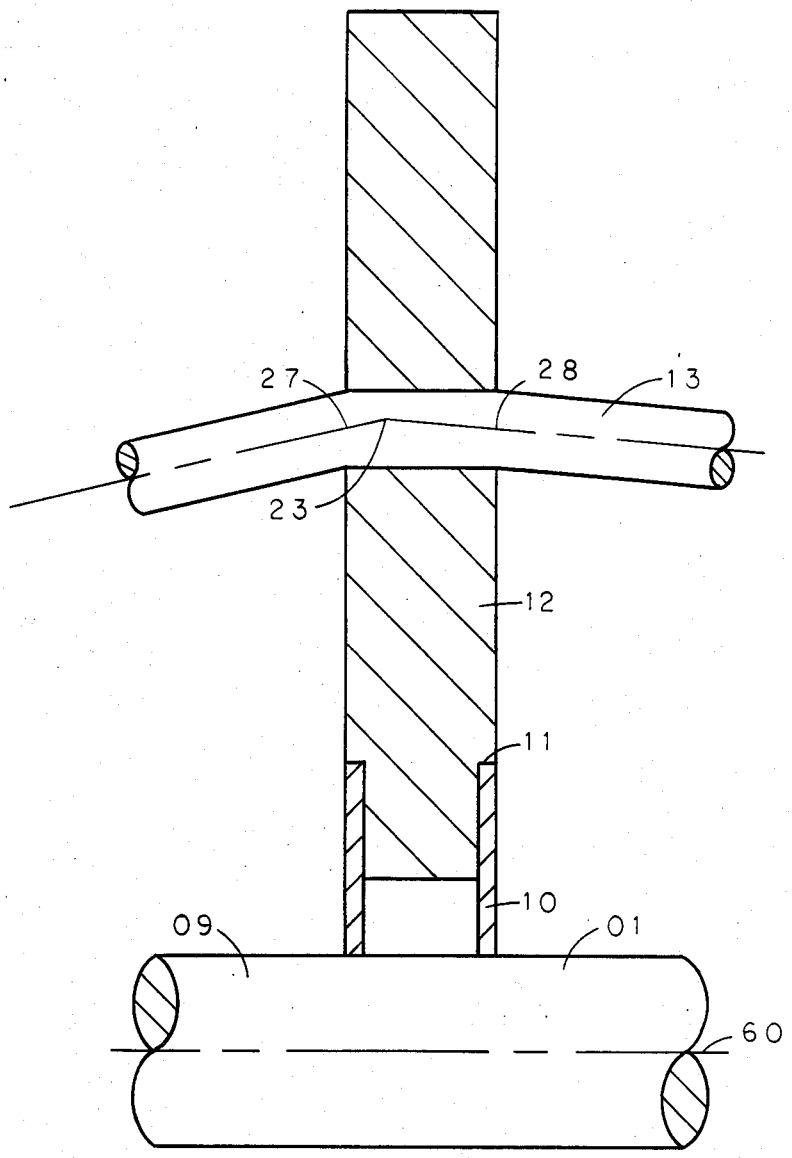
FIG. 5 is an enlarged sectional view of the guide and brace. The guide and brace are sectioned at line 160, 160 of FIG. 3.
Figure 6:
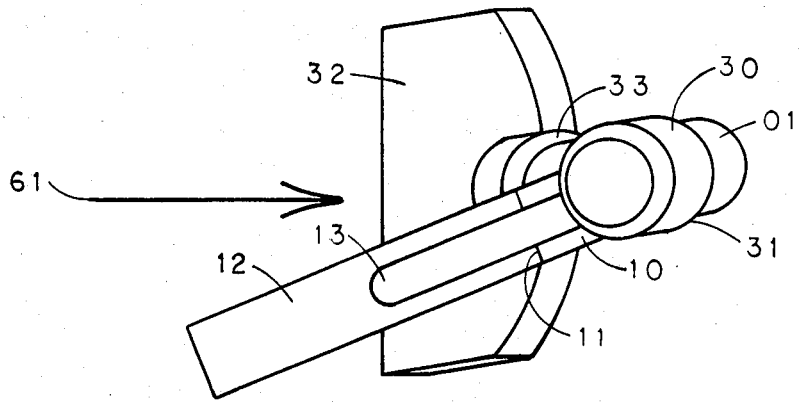
FIG. 6 is an enlarged end view of the oar with the jacket having been deleted in order to emphasize the shaft of the oar.
Figure 7:
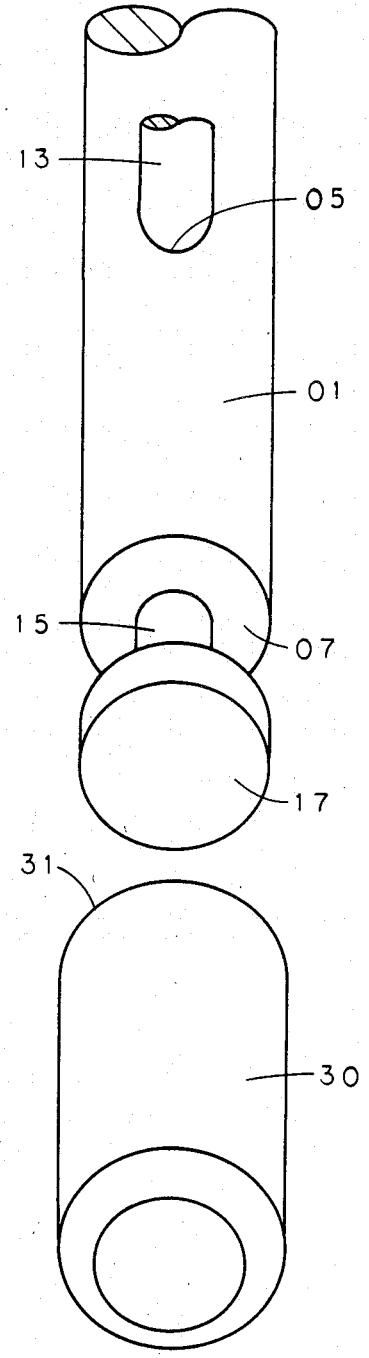
FIG. 7 is an enlarged perpsective view of the handle end of the oar.
Figure 8:
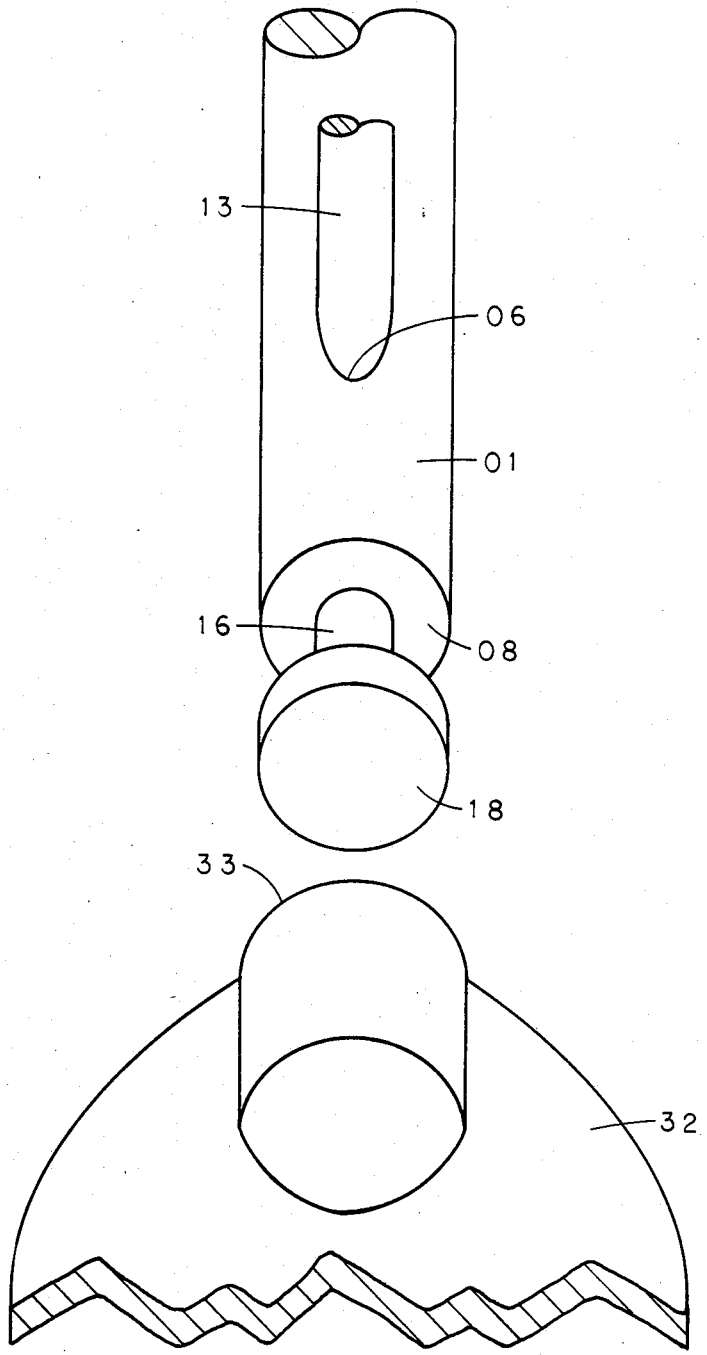
FIG. 8 is an enlarged perspective view of the blade end of the oar.

The oar shaft comprises a slender column 01. A brace 10 emanates from the column 01 and is adjacent to the part of the column where an oar lock is to be mounted

09. The brace 10 is fixed to the column 01. The end of the column 01 nearest the brace 10 may be fitted to the socket 31 of a handle grip 30, and the end of the column 01 farthest from the brace 10 is fitted to the socket 33 of an oar blade 32. A stay 13 originates at the blade end of the oar 03, passes through a guide 12 at the tip of the brace 11 and terminates at the handle end of the oar 02. The column 01 of the oar shaft is bowed toward the brace 10. The two points 25, 26, where the stay 13 emanates from the column 01 of the oar shaft, lie in the same plane as the set of points 27, 28 through which the stay 13 passes at the tip of the brace 11.

The stay 13 may be secured to the column 01 of the oar shaft in any suitable manner. The present example includes a stay 13 that passes through two holes 05, 06, on one side of the column 01 of the oar shaft. One hole 05 is located at the handle end of the oar shaft 02 and passes through the shaft facing 07 at the handle end of the column 01. The other hole 06 is located at the blade end of the oar shaft 03 and passes through the shaft facing 08 at the blade end of the column 01. The ends of the stay 15, 16, pass through the holes on the side of the oar shaft and extend beyond the shaft facings 07, 08, at each end of the column 01. The stay 13 is captured to the column 01, by separated retainers 17, 18, at each end of the stay 13.

Another feature of the oar shaft includes a jacket 52 that surrounds the oar shaft. The jacket 52 is comprised of material that floats in water.

OPERATION

The stay 13 and brace 10 bow the column 01 of the oar shaft and offset the blade 32 from the feathering axis of the oar 60. The guide 12 at the tip of the brace 11 holds the stay 13 on the brace 10. The plane, that has been defined previously by a set of points 27, 28, at the tip of the brace 11 and by the stay's two points of origin 25, 26, on the oar shaft, can be used as a reference for positioning the stay 13 and the brace 10 on the oar. The points that define the aforementioned plane 25, 26, 27, 28, may be aligned to form a triangle 20, 21, 22. The triangle 20, 21, 22, is assigned a vertex 23 near the tip of the bracket 11. When the oar blade 32 is normal to the water surface during an oar stroke, the vertex 23 of the aforementioned triangle 20, 21, 22 points downwardly with respect to the force direction of the blade 32 in the water. The downward angling of the aforementioned plane and of the triangle 20, 21, 22, therein results in the force of the blade 61 being located below the feathering axis 60 of the oar. Because of the location of the force of the blade 61 with respect to the feathering axis 60, a moment is created that tends to unfeather the oar. The tendency of the oar to unfeather may be arrested by an oar lock as long as a stop is provided in the oar lock to properly orient the oar blade 32 in the water. Proper orientation of the oar blade 32 is attained as soon as the blade 32 becomes normal to the surface of the water. However, an oarsman may orient the oar blade 32 during a stroke so that the force direction of the oar blade 61 acts above the feathering axis of the oar 60. The oar has the tendency in this case to feather. The oarsman must apply a sufficient countermoment before the catch in order to eliminate the feathering tendency of the oar. Unfeathering tendency of the oar is therefore always desirable as long as the oar is equipped with an oar lock of the type previously described.

The stay 13 and the brace 10 prevent bending stresses from occurring in the oar shaft column 01 during propulsion. The slender oar shaft column 01 is stronger in compression than in bending, and undergoes compressive stress as the blade of the oar 32 is drawn aftward through the water. The brace 10 also functions as a compression member and absorbs the forces that are exerted by the stay 13. The stay 13 undergoes tensile stress throughout the stroke and partially absorbs the forces that are created by the resistance of the aftward movement of the oar blade through the water.

In the previously described method for anchoring the stay 13 to the oar shaft column 01, the retainers 17, 18 maintain tension in the stay 13 and capture the stay 13 to the oar shaft column 01. The capturing of the stay 13 to the oar shaft column 01 prevents the stay 13 from sliding through the holes 05, 06, in the column 01.

The jacket 52 allows the oar to float in water. Flotation of the oar in water is accomplished by maintaining a buoyant effect. The jacket 52 is therefore comprised of a suitable buoyant material. The jacket 52 covers the oar so that the oar shaft column 01 is surrounded with the aforementioned buoyant material. Due to the tubular shape of the jacket 52 and the buoyant material thereof, the jacket 52 may be located at different points along the oar shaft column 01.

While the above description contains many specifications, these should not be construed as limitations on the scope of the invention, but rather as an exemplification of one preferred embodiment thereof. Many other variations are possible. For example, some of these variations include an oar shaft having a cross-section of any suitable shape, an oar shaft having any number of methods for anchoring a stay. Accordingly, the scope of the invention should be determined not by the embodiment illustrated, but by the appended claims and their legal equivalents.

What is claimed is:

1. A force system for an oar, said oar used in propelling a boat over the surface of a body of water said oar consisting of a shaft column having a handle at one end and a blade at the other end, said system comprising:

a. an oar;

b. an oar lock location on shaft of said oar;

c. a single brace emanating from said shaft of said oar and being adjacent to said oar lock location;

d. a stay;

e. means for guiding said stay, with said stay passing through said guiding means, said guiding means being supported by said brace;

f. means for anchoring said stay, with said anchoring means maintaining tension in said stay and securing said stay to said shaft of said oar so as to bow the entire shaft with the ends of said oar being bowed toward said stay to offset the blade of said oar;

g. two points, from which said stay emanates on said shaft of said oar, with first point being adjacent to said blade, and with second point being adjacent to handle of said oar;

h. a set of points, through which said stay passes thru said guiding means;

i. a plane, in which said two points lie with said set of points;

j. a triangle, that is aligned from said two points and from said set of points, with the vertex of said triangle being located the vicinity of said guiding means; so that said shaft and said brace, upon aftward movement of said blade through water, undergo compressive stress;

k. means for angling and downwardly directing said plane, such that said triangle and the aforementioned vertex therof point downwardly with respect to force direction of said blade.

2. A system for securing a stay to an oar, said oar used in propelling a boat over the surface of a body of water, said oar consisting of a shaft column having a handle at one end and a blade at the other end, said system comprising:

a. a stay;

b. a shaft column of said oar, with two holes on one side of said shaft column, with a shaft facing at the handle end of said shaft column, and with a shaft facing at the blade end of said shaft column, with first hole of said shaft column being adjacent to said handle end and passing through said shaft facing at said handle end, and with second hole of said shaft column being adjacent to said blade end and passing through said shaft facing at said blade end, so that ends of said stay extend toward side of said shaft column and pass through the holes thereof in such manner as to extend beyond said shaft facings of said shaft column of said oar;

c. a handle grip socket that fits said handle end of said shaft column;

d. a retainer at end of said stay nearest said handle end of said shaft column, with said retainer maintaining tension in said stay and capturing said stay to said shaft column, so that the end of said shaft column nearest said handle end of said shaft column may be fitted to said handle grip socket;

e. an oar blade socket that fits said blade end of said shaft column;

f. a retainer at end of said stay nearest said blade end of said shaft column, with said retainer maintaining tension in said stay and capturing said stay to said shaft column, so that the end of said shaft column nearest said blade end of said shaft column may be fitted to said oar blade socket.

3. A system as in any of the preceding claims, in which a buoyant effect is maintained so as to provide said oar with means for floating in water comprising:

a. a buoyant element;

b. a jacket containing said buoyant element;

c. means for covering shaft of said oar with said jacket with said covering means locating said jacket on shaft of said oar, so that said oar can float in water.

* * * * *